US007753700B2

(12) United States Patent
Ma

(10) Patent No.: US 7,753,700 B2
(45) Date of Patent: Jul. 13, 2010

(54) SAFETY PROTECTION STRUCTURE FOR UNIVERSAL SOCKETS

(75) Inventor: Hing Wai Michael Ma, Kowloon (CN)

(73) Assignee: Cord-It Limited, Kowloon, Hong Kong (CN)

( * ) Notice: Subject to any disclaimer, the term of this patent is extended or adjusted under 35 U.S.C. 154(b) by 0 days.

(21) Appl. No.: 12/287,568

(22) Filed: Oct. 10, 2008

(65) Prior Publication Data

US 2010/0093198 A1 Apr. 15, 2010

(51) Int. Cl.
*H01R 13/44* (2006.01)

(52) U.S. Cl. ..... 439/133

(58) Field of Classification Search ..... 439/133–137
See application file for complete search history.

(56) References Cited

U.S. PATENT DOCUMENTS 5,020,997 A * 6/1991 Calderara et al. ..... 439/137
5,069,630 A * 12/1991 Tseng et al. ..... 439/137
5,702,259 A * 12/1997 Lee ..... 439/137
5,998,735 A * 12/1999 Patterson, Jr. ..... 174/67
6,286,745 B1 * 9/2001 Ackeret ..... 227/76
6,786,744 B1 * 9/2004 Lee ..... 439/137
6,932,631 B2 * 8/2005 Huang ..... 439/145
7,445,472 B1 * 11/2008 Huang et al. ..... 439/138
7,445,513 B1 * 11/2008 Lee ..... 439/652
7,445,538 B2 * 11/2008 Hanamoto et al. ..... 446/390

* cited by examiner

*Primary Examiner*—Truc T Nguyen
(74) *Attorney, Agent, or Firm*—Alix, Yale & Ristas, LLP

(57) ABSTRACT

A safety protection structure for universal sockets, comprising: a second module; a second slant to contact the second pin of a 3-pin plug; a sliding chute configured in parallel to the movement direction of the second module; a third module; a third slant to contact the third pin of a 3-pin plug, and matching the sliding chute of the second module. The sliding chute is configured to ensure that the third and the second module are relatively independent and movable. The second module and third module are respectively configured with a surface area to block the second pin and third pin of the 3-pin plug at the same time. In this configuration, the insulation board is closed when the pin of the plug is inserted incorrectly preventing the pin from contacting the conducting plate in the socket, and the insulation boards in the jacks not inserted with the pins remain closed.

11 Claims, 17 Drawing Sheets

SAFETY PROTECTION STRUCTURE FOR UNIVERSAL SOCKETS

BACKGROUND OF INVENTION

1. Field of the Invention

The present invention relates generally to an improved universal socket structure, and more particularly to an improved universal socket structure which is adaptable to 2-pin or 3-pin plugs of multiple specifications. The main improvement is the socket safety protection structure which can prevent incorrect plugging and ensure safety.

2. Description of Related Art

Prior-art sockets are commonly seen and according to their configurations for different positions can be divided into fixed sockets to be mounted on walls, portable sockets extending from fixed sockets (alternatively called patch boards, or adaptive sockets), and universal adapters configured to be adaptable to different national specifications. The basic function of these sockets is to ensure successful connection of electric circuit.

However, all these sockets have safety problems. For example, in case of misoperation or incorrect operation by children, the plug may be inserted in the wrong direction or even a finger will be inserted into the jack of the socket, causing personal injury. Hence, various countries, especially the developed countries, have established strict safety standards.

At present, certain types of sockets have added some protection facilities, for example, a safety protection structure is configured behind the jack on the upper case of the socket upper case. Such safety protection structure is usually an insulation board supported by a spring. Unless the plug pins are inserted, the spring-supported insulation boards will ensure that the conducting plates behind the jack are not exposed.

Although such general improvements have enhanced the safety performance of sockets, there is still a likeness of danger when the insulation board is opened by a user operating the plug incorrectly. Such danger may come from neglect of the user inserting only one pin of the plug. This is especially the case for portable sockets adaptable to plug specifications of various countries. Due to the different plug specifications of various countries, there is often a possibility that the user only inserts one pin into the jack in an unfamiliar operational environment. This poses potential safety hazard and does not comply with the safety requirements of some countries.

Thus, to overcome the aforementioned problems of the prior art, it would be an advancement of the art to provide an improved structure that can significantly improve the efficacy.

SUMMARY

A safety protection structure is provided for universal sockets to ensure that the pin of the plug will not contact the conducting plate in the socket when the operator only inserts one pin or inserts the pins in a wrong direction.

A safety protection structure for universal sockets is configured between the upper case and lower case of a universal socket in correspondence to the jack on the upper case to prevent abnormal connection between the plug and the conducting plate in the universal socket. The safety protection structure comprises:

a first module, with a first slant contacting the first pin of a 3-pin plug;

a second module, with a second slant contacting the second pin of a 3-pin plug, and a sliding chute configured in parallel to the movement direction of said second module; and a third module, with a third slant contacting the third pin of a 3-pin plug, and matching the sliding chute of the second module, wherein the sliding chute is configured to ensure that the third module and the second module are relatively independent and movable.

The abovementioned second module and third module are respectively configured with a surface area to block the second pin and third pin of the 3-pin plug at the same time.

The abovementioned first module is configured with a bottom surface to push the second module and third module and make them move simultaneously.

The abovementioned safety protection structure has an overlapped U-notch configured in the center of the second module and third module for positioning during assembly.

The abovementioned safety protection structure has the upper case and the lower case configured with clasps to form walls and an enclosure space to house the safety protection structure.

The abovementioned safety protection structure has the bottom of the walls configured with two notches for mounting two springs to support the bottom surfaces of the second module and third module respectively.

The abovementioned safety protection structure has the side of the third module configured with a positioning projection to match the retaining groove on the second module wherein the retaining groove is an opening of the sliding chute on the wall of the second module.

The abovementioned safety protection structure has the width of said first slant matching the width of the first pin of a specific 3-pin plug when inserted correctly; meanwhile, the width of the second slant and third slant is configured to be smaller than the width of the corresponding pin of a specific 3-pin plug.

The abovementioned safety protection structure incorporates a British Standard 13a plug as the 3-pin plug.

The abovementioned safety protection structure employs the jacks on the upper case which are configured to be adaptable to universal jacks of multiple specifications.

A safety protection structure for universal sockets is configured between the upper case and lower case of a universal socket in correspondence to the jack on the upper case to prevent abnormal connection between the plug and the conducting plate in the universal socket. The safety protection structure comprises a second module, with a second slant contacting the first pin of a 2-pin plug, and a sliding chute configured in parallel to the movement direction of the second module. A third module, with a third slant contacting the second pin of a 2-pin plug, matches the sliding chute of the second module. The sliding chute is configured to ensure that the third module and the second module are relatively independent and movable.

The abovementioned second module and third module are respectively configured with a surface area to block the first pin and second pin of the 2-pin plug at the same time.

The abovementioned safety protection structure has an overlapped U-notch configured in the center of the second module and third module for positioning during assembly.

Due to the independently configured second module and third module as described in the above technical scheme, the safety protection structure for universal sockets ensures safety when the user operates incorrectly. It ensures that the insulation board is closed when the pin of the plug is wrongly inserted. Not only the inserted pin will not contact with the conducting plate in the socket, but also the insulation boards in the jacks not inserted with the pins will remain closed.

DETAILED DESCRIPTION OF THE INVENTION

Figure 1A:
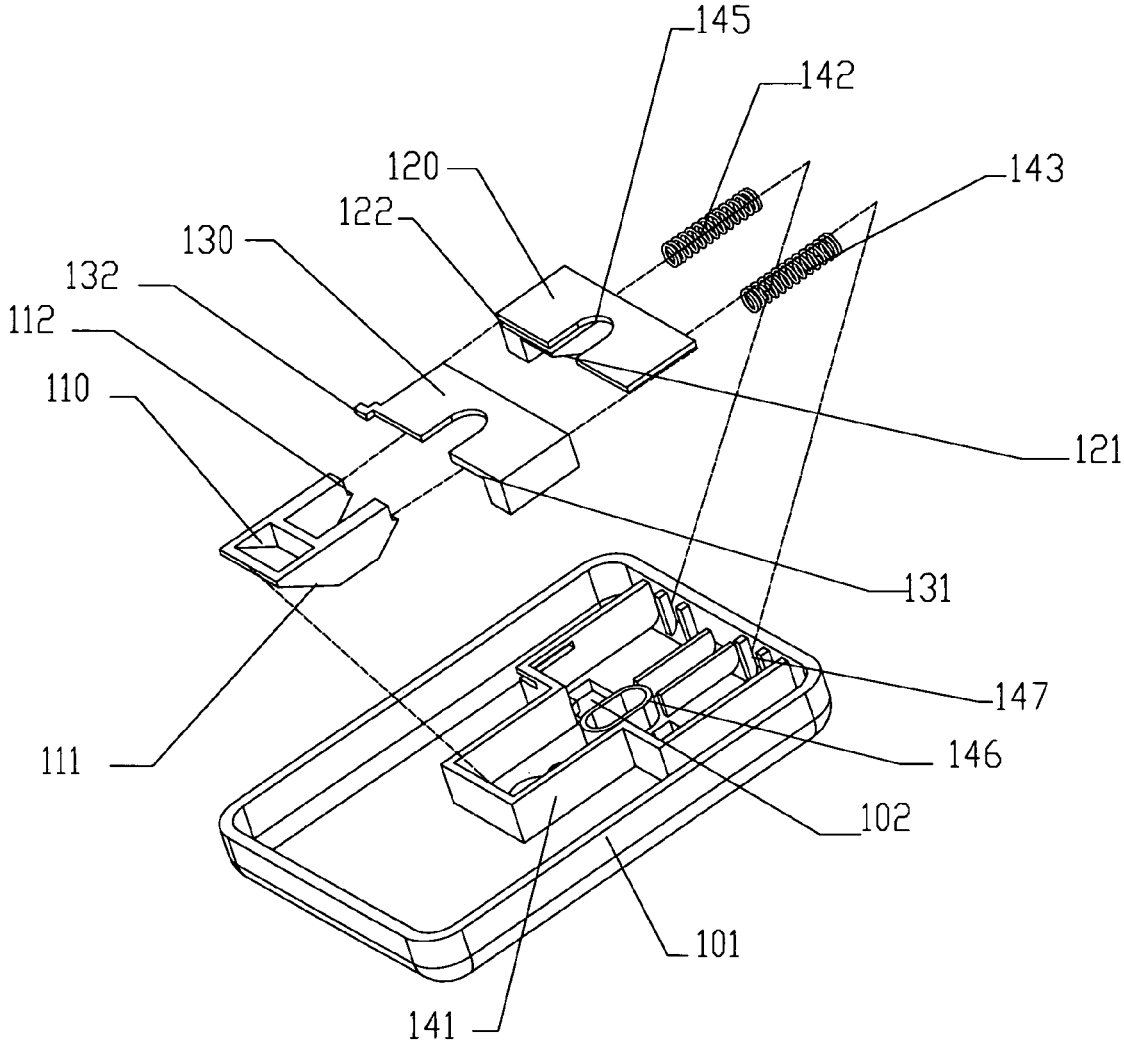
FIG. 1*a* and FIG. 1*b* are the exploded views of a universal socket with the lower case removed.
Figure 1B:
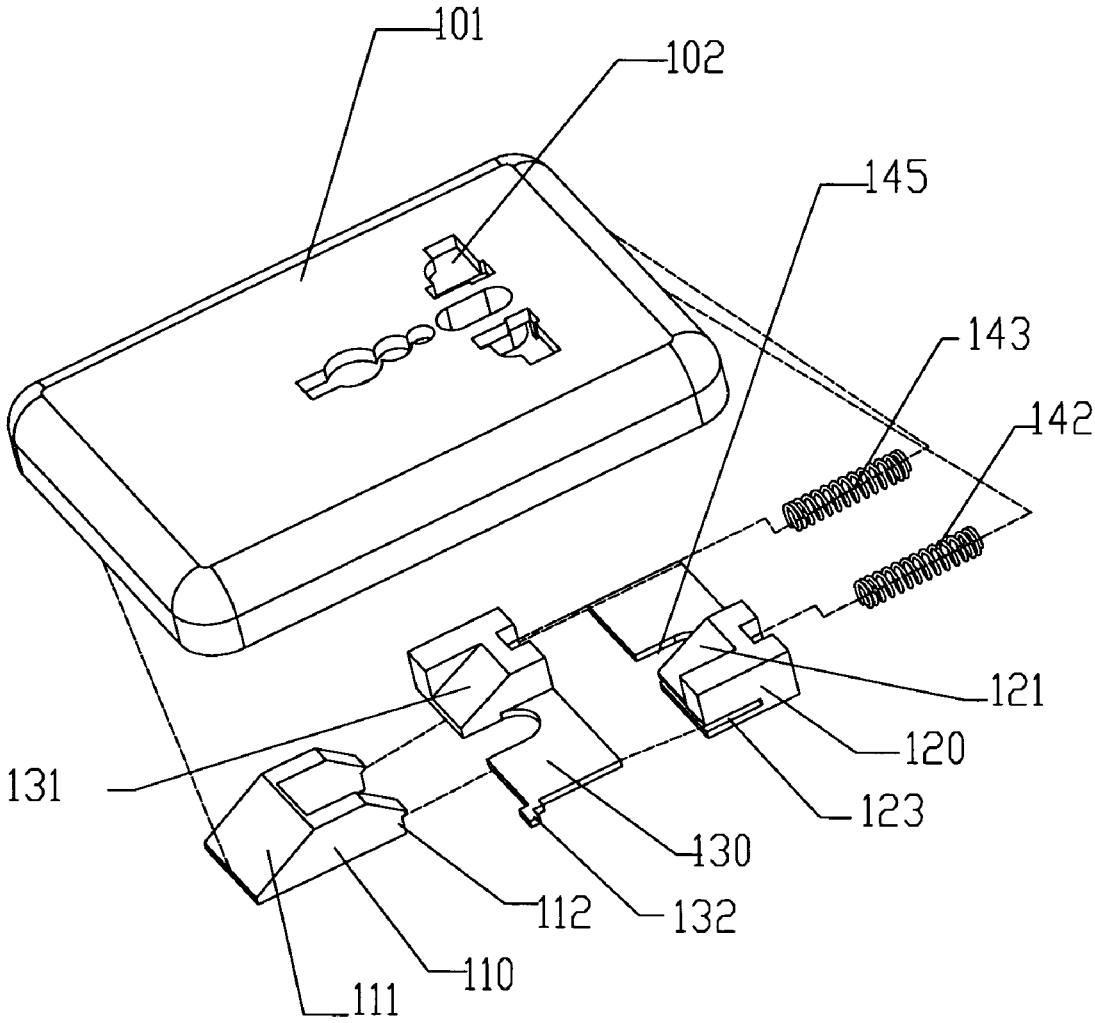

The universal socket safety protection structure as shown in FIG. 1*a* and FIG. 1*b*, is configured between the upper case 101 and the lower case of the universal socket (for better illustration, the lower case is not shown in the Figure). The lower case matches and clasps with the upper case 101 to form a closed space; a jack 102 is configured on the upper case 101. The safety protection structure is configured underneath the jack, and is basically made of insulation material to prevent the plug from contacting the conducting plate in the universal socket, and to prevent abnormal connection between the conducting plates in the universal socket. For example, when only one pin of the plug is inserted, or when the plug is inserted in a wrong direction, the safety protection structure will remain unconnected.

The safety protection structure for universal sockets as shown in FIG. 1*a* and FIG. 1*b*, comprises a first module 110, a second module 120 and a third module 130, which are configured on the corresponding walls of the upper case and lower case. The walls 141 enclose to house the first module 110, second module 120 and third module 130 as well as other accessories, such as the spring 142 and 143 to support the safety protection structure.

In the safety protection structure, the said first module 110 has a first slant 111 to contact the first pin of the a 3-pin plug; the second module 120, has a second slant 121 to contact the second pin of a 3-pin plug, and a sliding chute 122 is configured on the second module 120 in parallel to the movement direction of said second module 120; the third module 130 has a third slant 131 to contact the third pin of a 3-pin plug. The third module 130 is formed in the shape of a panel that matches the sliding chute 122 of the second module 120 and ensures that the third module 130 and the second module 120 are relatively independent and movable. As the sliding chute 122 is in parallel to the movement direction of the second module 120, i.e. the movement direction of the third module 130, the third module 130 can move within the sliding chute 122 independent of the second module 120.

The second module 120 and the third module 130 are respectively configured with an area large enough to block the conducting plates corresponding to the second pin and the third pin of a 3-pin plug when inserted. In this way, when the socket of the present invention is used for a 2-pin plug or a 3-pin plug, if only one jack has a pin inserted, the matching with second slant 121 or third slant 131 will only cause the second module or the third module to move down, while the third module or the second module configured in parallel will remain unconnected. This makes sure that the pin will not contact the corresponding conducting plate when only one pin is inserted; meanwhile, the conducting plate in the jack not inserted with a pin will still be protected by the insulation board, causing no danger of exposure or electric shock.

Figure 2A:
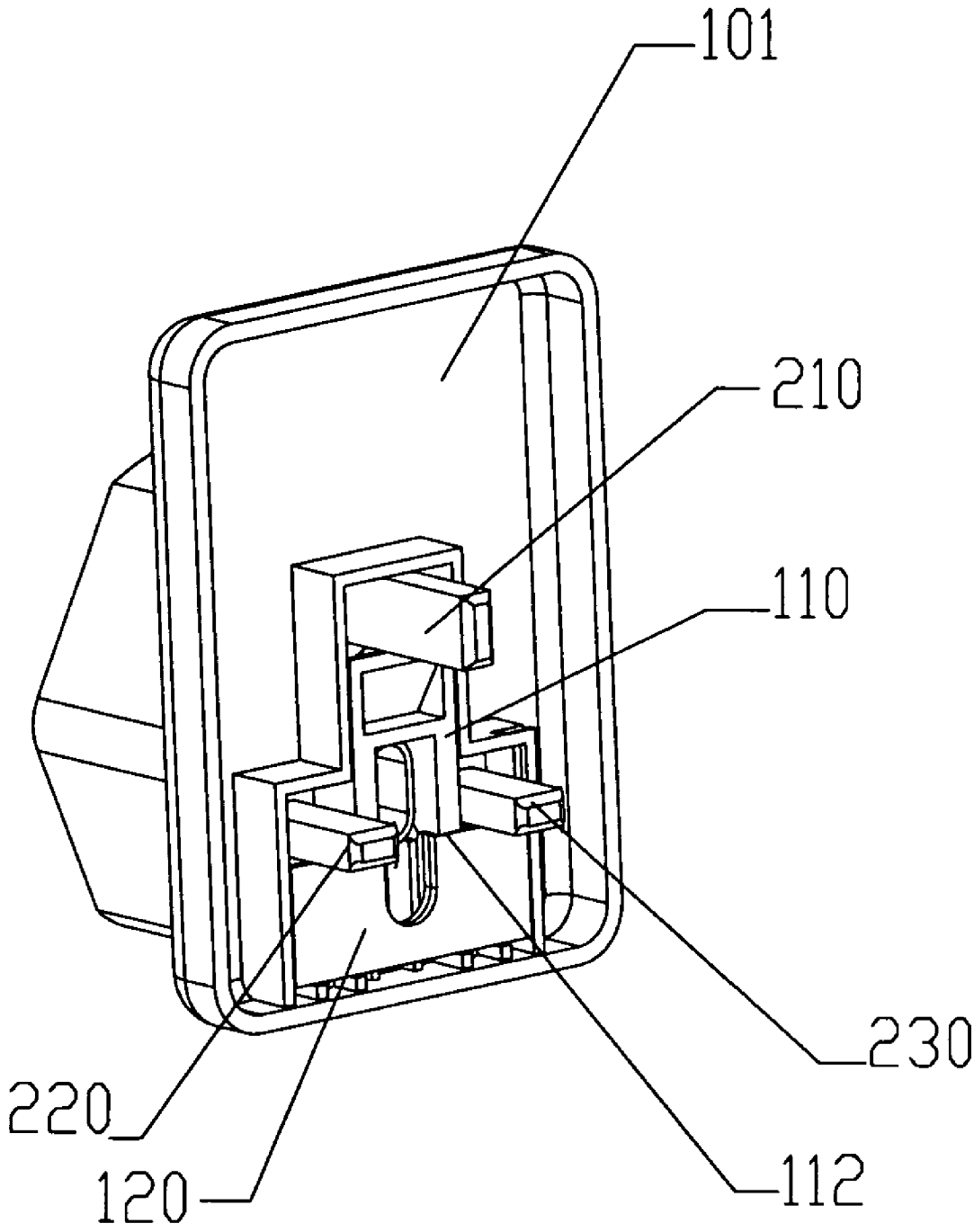
FIG. 2*a*-FIG. 2*k* are illustrations of the safety protection structure for universal sockets adapted to British Standard 13a plugs.

On the bottom of the first module 110, a bottom surface 112 is configured to push the second module 120 and third module 130 at the same time and make them move downward. This is designed for compatibility with some specified plugs like the British Standard plug 13*a*, which is a 3-pin plug, as shown in FIG. 2*a*, with the first pin 210 being longer than the second pin 220 and the third pin 230 and all three pins being square of different sizes. Hence, when a British Standard 13a plug is used, under the condition of correct operation, the first pin 210 will be inserted into the jack on the upper case in the first place, and contact the first slant 111 on the first module 110, pushing the first module 110 to move downward. When the first module 110 is moving downward, its bottom surface 112 will push the second module 120 and third module 130 to move downward at the same time. At this time, the second pin 220 and the third pin 230 of the plug are inserted at the same time, and can perfectly contact their corresponding conducting plates. The connection process is shown in FIG. 2*d*-FIG. 2*g*.

Figure 2B:
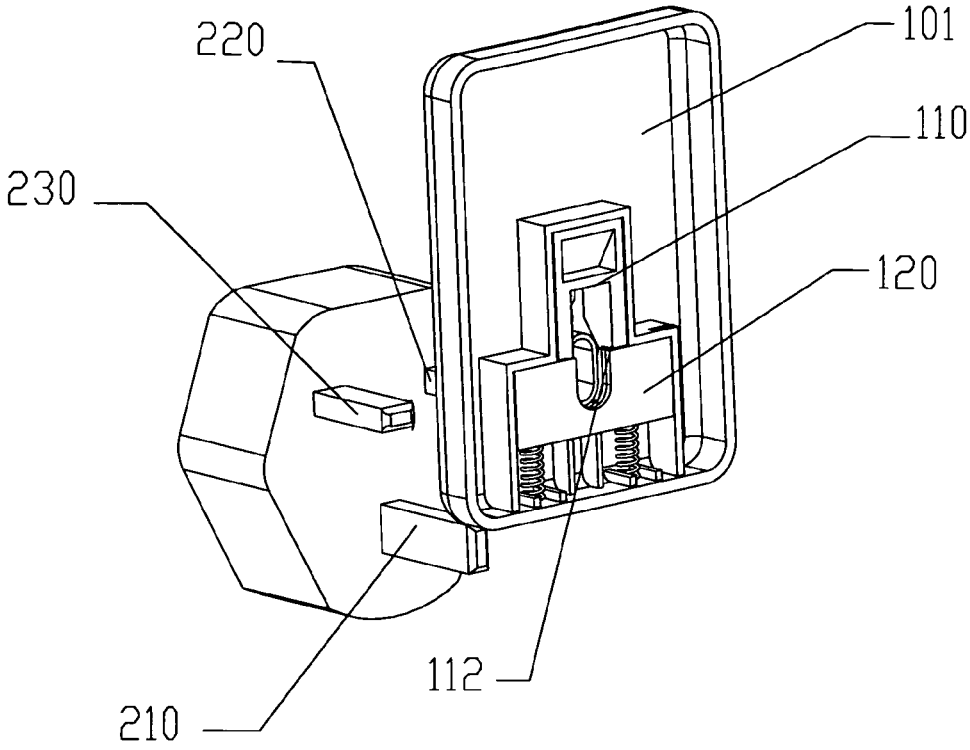

In case of misoperation with the British Standard 13a plug when only one pin is inserted, as shown in FIG. 2*b*, as the second module 120 and third module 130 are still blocking their corresponding conducting plates, the conducting plates will not be exposed or contact the pins. This ensures safety under the condition of misoperation, as shown in FIG. 2*h* and FIG. 2*i*.

Figure 2C:
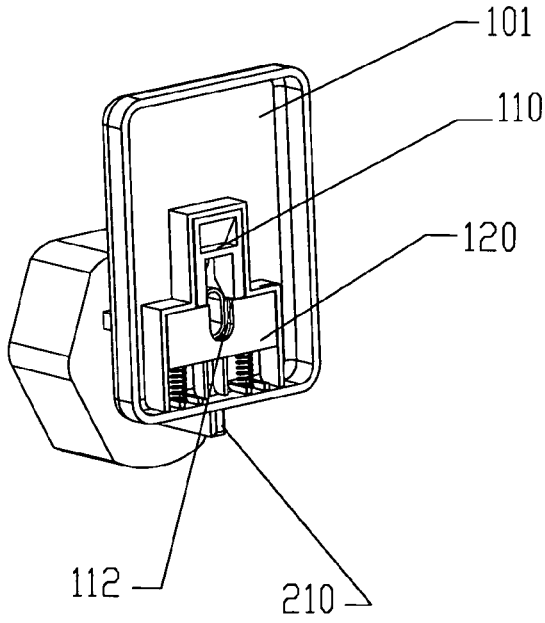
Figure 2D:
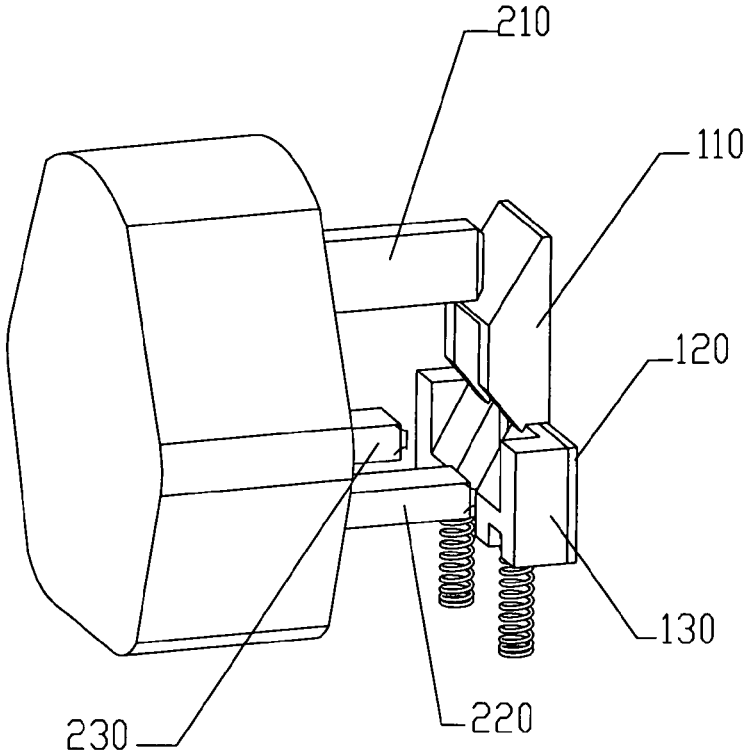
Figure 2E:
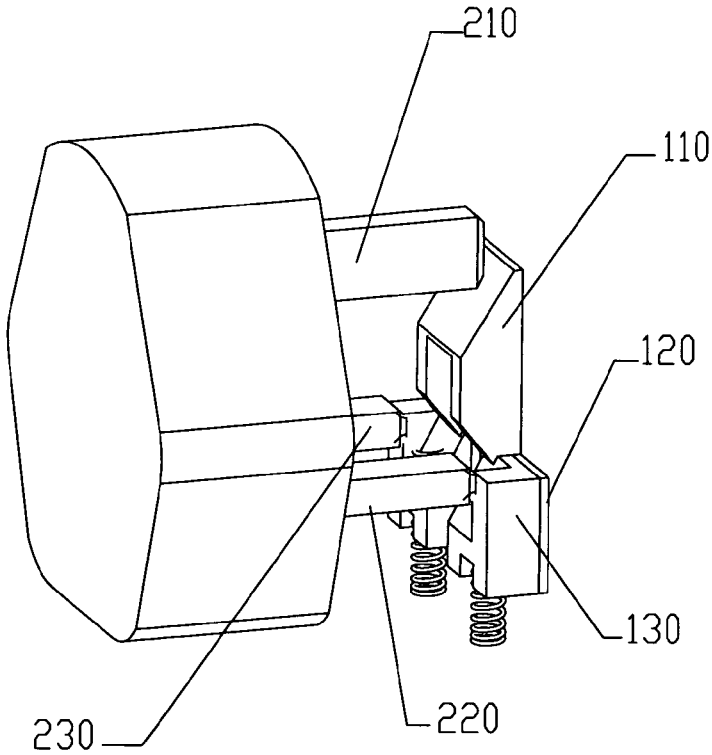
Figure 2F:
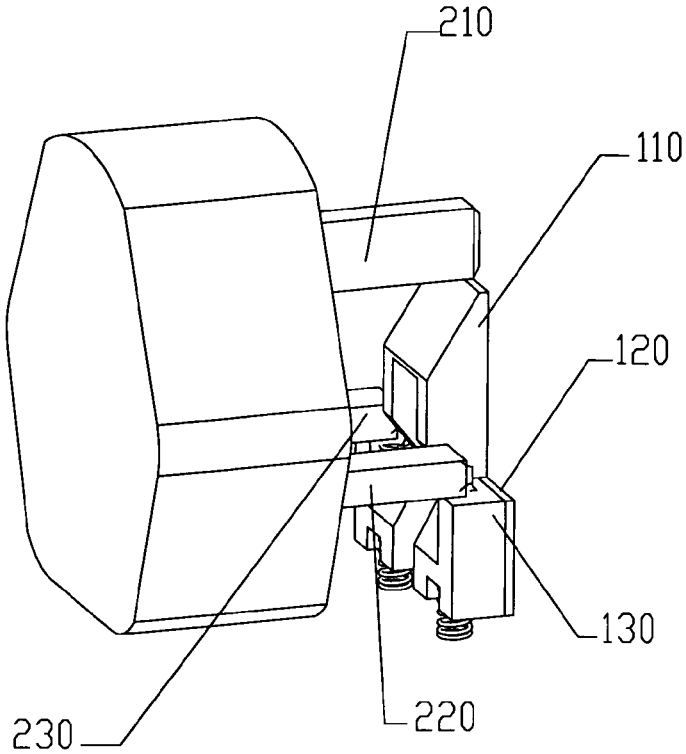
Figure 2G:
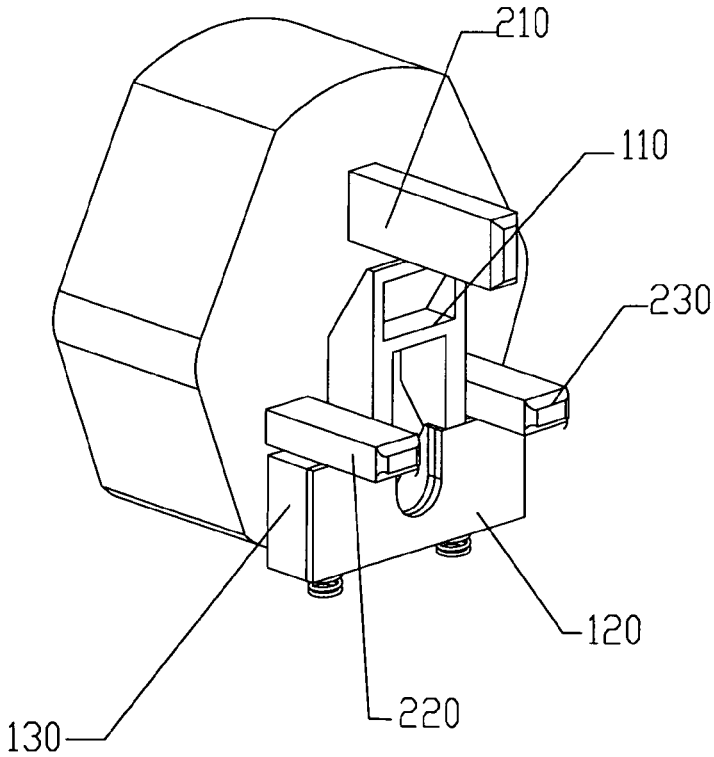
Figure 2H:
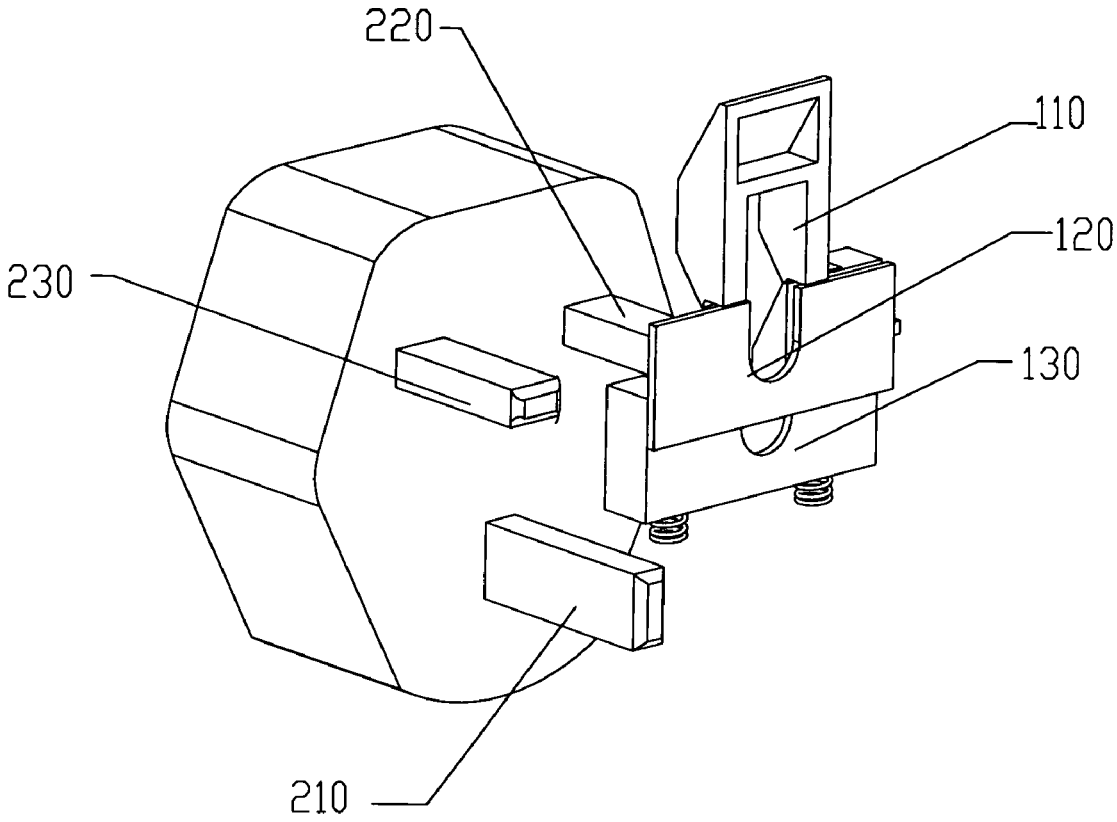
Figure 2I:
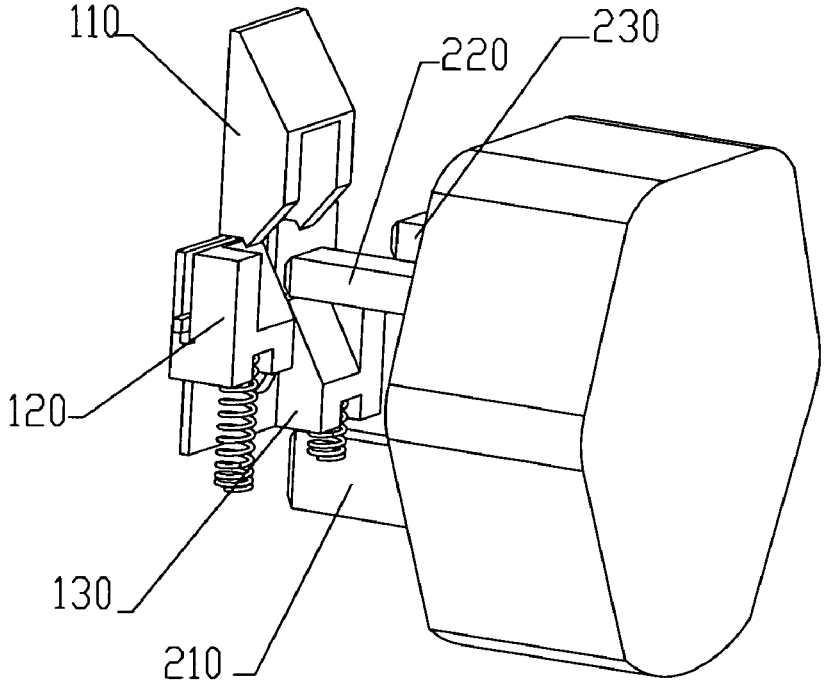
Figure 2J:
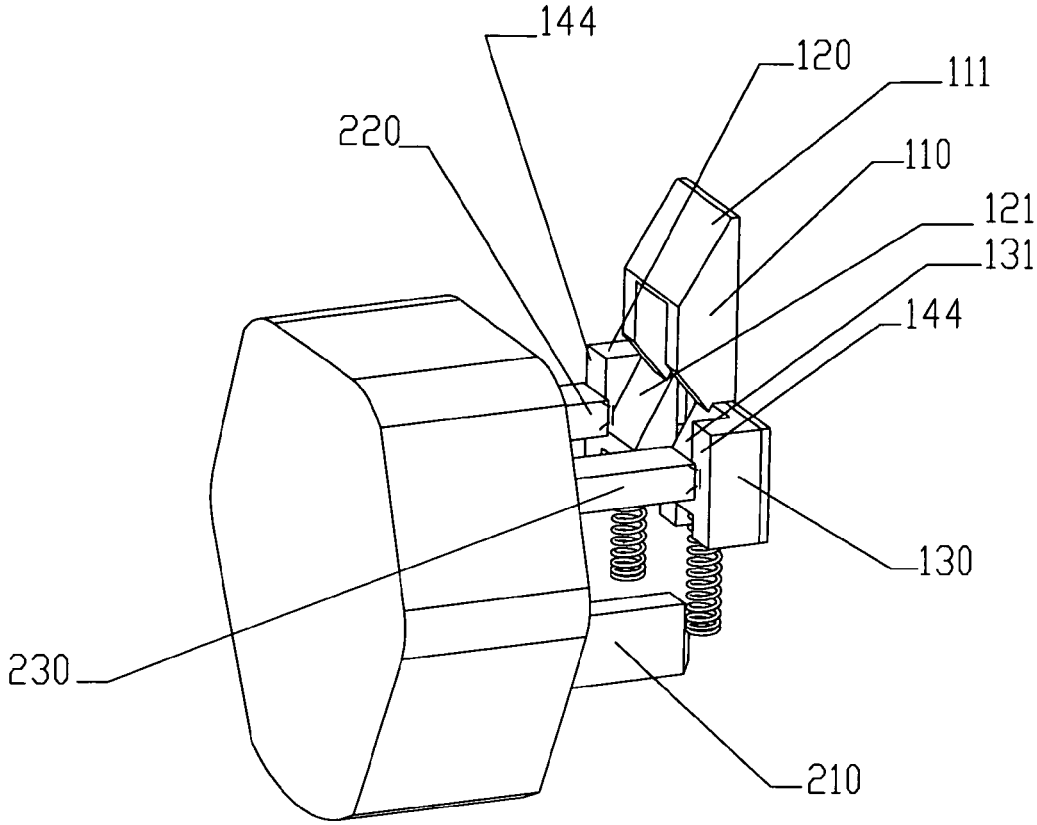
Figure 2K:
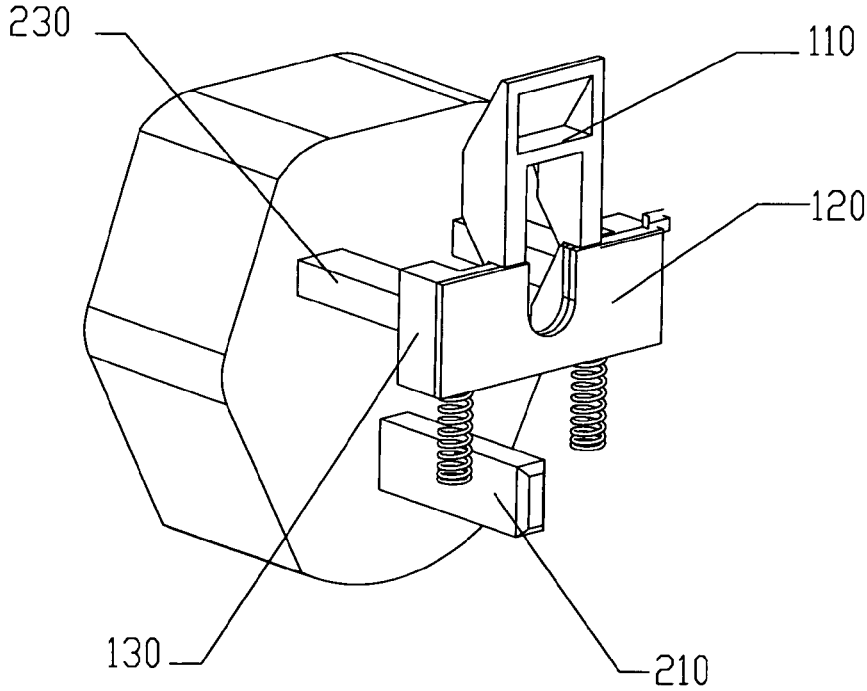

When the second pin 220 and the third pin 230 are inserted into the jacks corresponding to the third module 130 and the second module 120 at the same time, the inserting direction is wrong, as shown in FIG. 2*c*. As the first module 110 is still blocking the corresponding conducting plate, it makes sure that the jack corresponding to the first module will not expose the conducting plate; meanwhile, to ensure safety upon such misoperation with a British Standard 13a plug, the width of the first slant 111 is configured to be compatible with the width of the first pin of a British Standard 13a plug when inserted correctly, and the width of the second slant 121 and third slant 131 is configured to be lower than the width of the second pin 220 and the third pin 230 when inserted at any angle, so that correct connection will only be possible when the first pin 210 is correctly inserted to push the second module 120 and the third module 130 through the bottom surface 112 of the first module; Under such a condition of misoperation, the second pin 220 and third pin 230 can only contact the platform 144 on top of the second slant 121 and third slant 131, as shown in FIG. 2*j*, and cannot open their corresponding insulation boards to contact their corresponding conducting plate, ensuring safety of the operator.

In the safety protection structure, an overlapped U-notch is configured in the center of the second module 120 and the third module 130 for positioning during assembly. In the wall 141, a protruding positioning part 146 is configured to fit the U-notch 145, as shown in FIG. 1*a*.

In the safety protection structure for universal sockets at the bottom of said wall 141, two notches 147 are configured to fit the two springs 142 and 143, to respectively support the bottom surface of the slants of the second module 120 and the third module 130, as shown in FIG. 1*a* and FIG. 1*b*.

In the safety protection structure, the side of the third module 130 is configured with a positioning projection 132, as shown in FIG. 1*a* and FIG. 1*b*, to match the retaining groove 123 on the second module 120. The retaining groove 123 is an opening and extension of the sliding chute 122 on the side wall of the second module 120. The positioning projection 132 ensures that the third module 130 can move in parallel with the second module 120. On the other hand, the configuration of the retaining groove 123 will ensure free movement of the third module independent of the second module.

For special needs, the universal socket safety protection structure may need to configure the jacks on the upper case to be compatible with multiple specifications of universal jacks. Such jacks are commonly seen in prior-art and are not further described here.

Meanwhile, it should be noted that, the structure of above-mentioned first module 110 is mainly for 3-pin plugs. Of course, the universal socket compatible with 3-pin plugs is also compatible with 2-pin plugs.

Moreover, the universal socket can be configured to be compatible only with 2-pin plugs. In such case, the structure of first module 110 can be removed, and the upper case, lower case and wall, etc., of the safety protection structure can be adjusted to produce sockets only for 2-pin plugs. As the main improvement in the sockets for 2-pin plugs is only the removal of the first module, the structures without the first module are all compatible with universal sockets specific for 2-pin plugs, and are herein not described in detail.

Following are several examples of plug specifications other than the British Standard 13a to demonstrate the advantages of the universal socket structure.

Figure 3A:
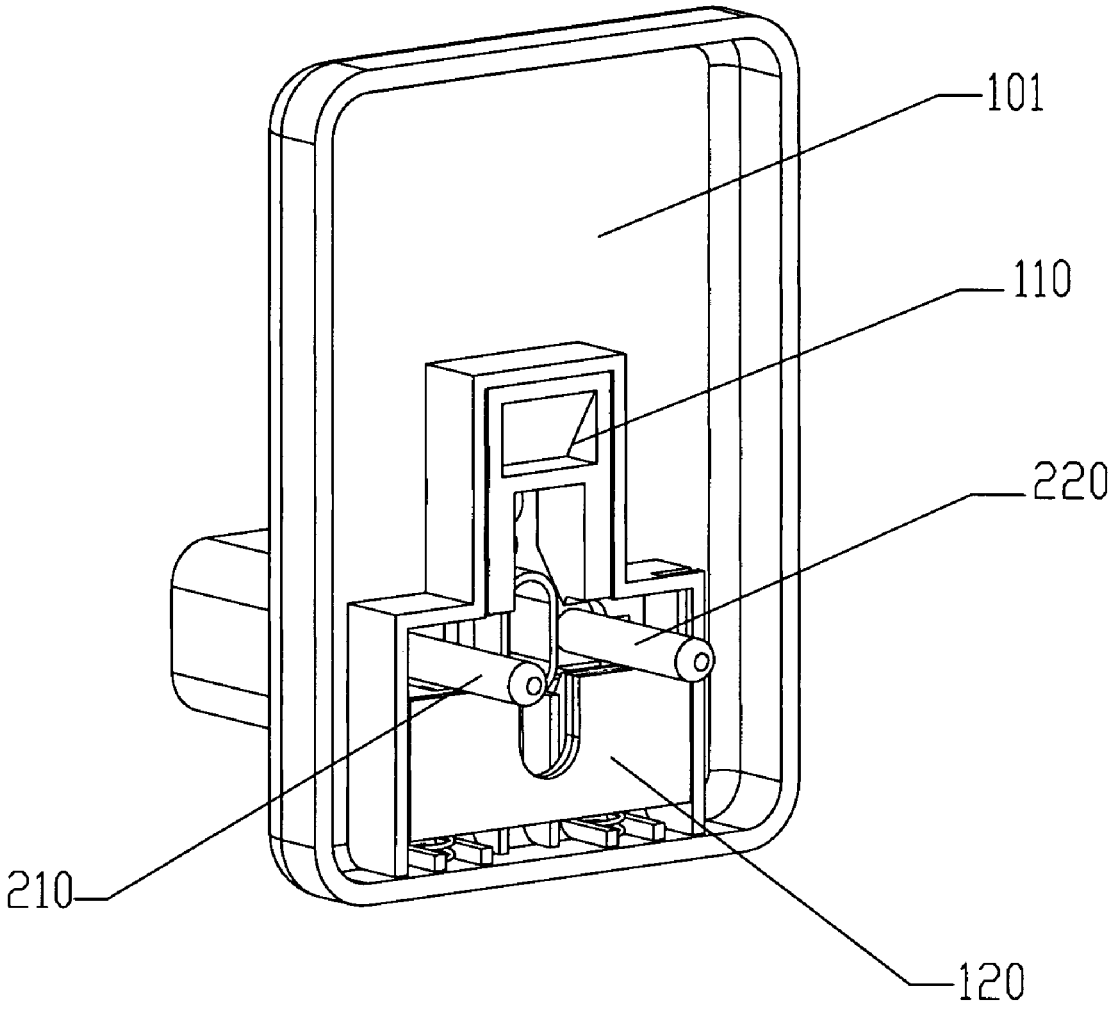
FIG. 3*a*-FIG. 3*c* are illustrations of the safety protection structure for universal sockets adapted to column-terminal 2-pin plugs.
Figure 3B:
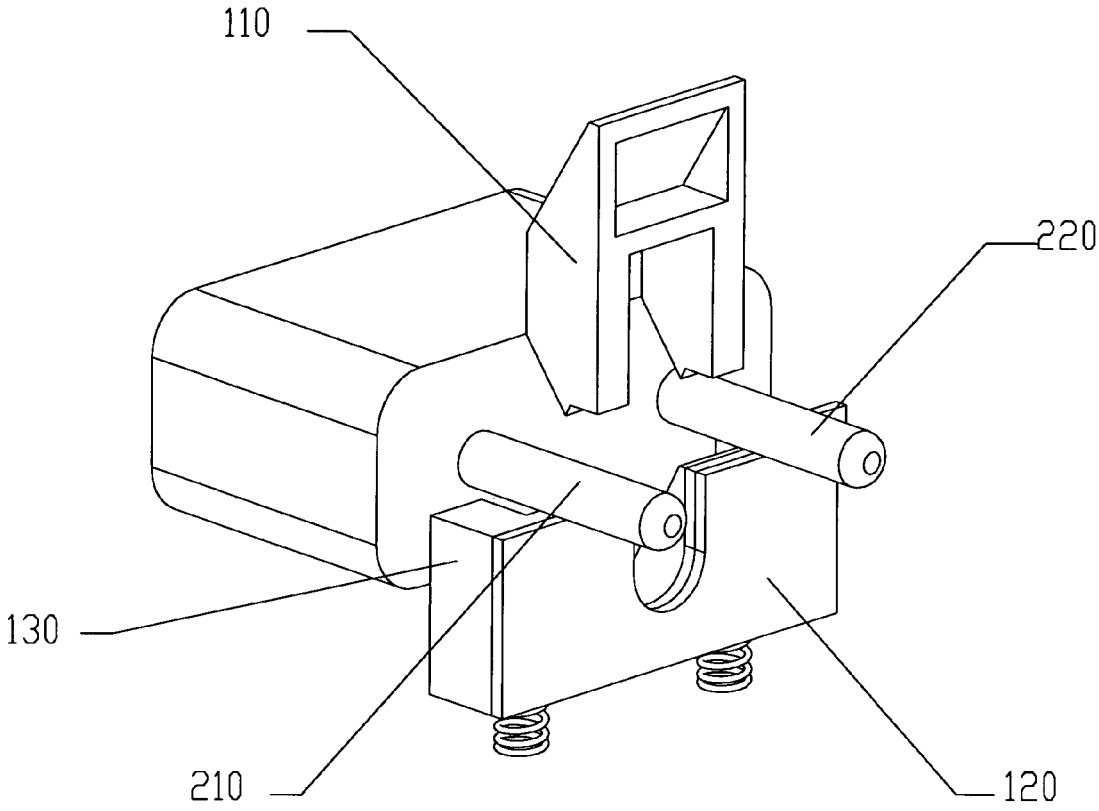
Figure 3C:
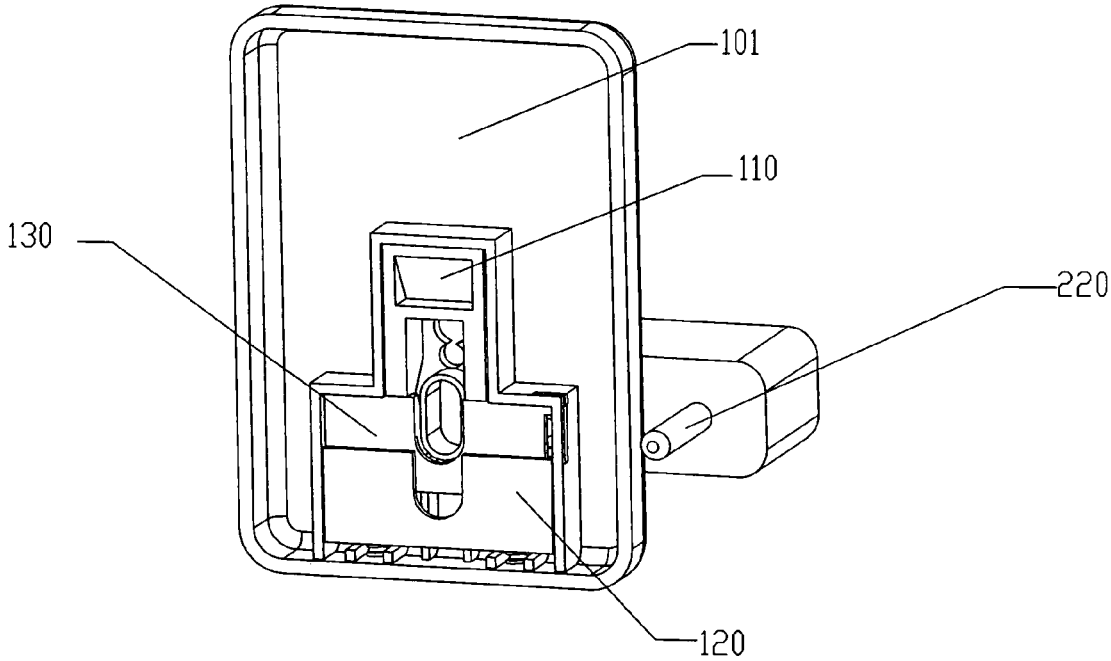

FIG. 3*a* and FIG. 3*b* are general views of a column-terminal 2-pin plug after correct fitting. When the first pin 210 and second pin 220 of the column-terminal 2-pin plug are inserted into the jacks on the upper case 101 of the socket, their top ends will touch the second slant 121 and the third slant 131, and push the second module 120 and the third module 130 to move downward, making the first pin 210 and the second pin 220 touching their corresponding conducting plates respectively and accomplishing a correct connection. FIG. 3*c* illustrates a situation when the pins are inserted incorrectly. No matter, the pin is inserted into the jack corresponding to the second module or the third module, as only one module is moved, the other module will block the conducting plates in both jacks, ensuring that the pin inserted will not be connected. Meanwhile, the jack not inserted with a pin will not expose the conducting plate.

Figure 4A:
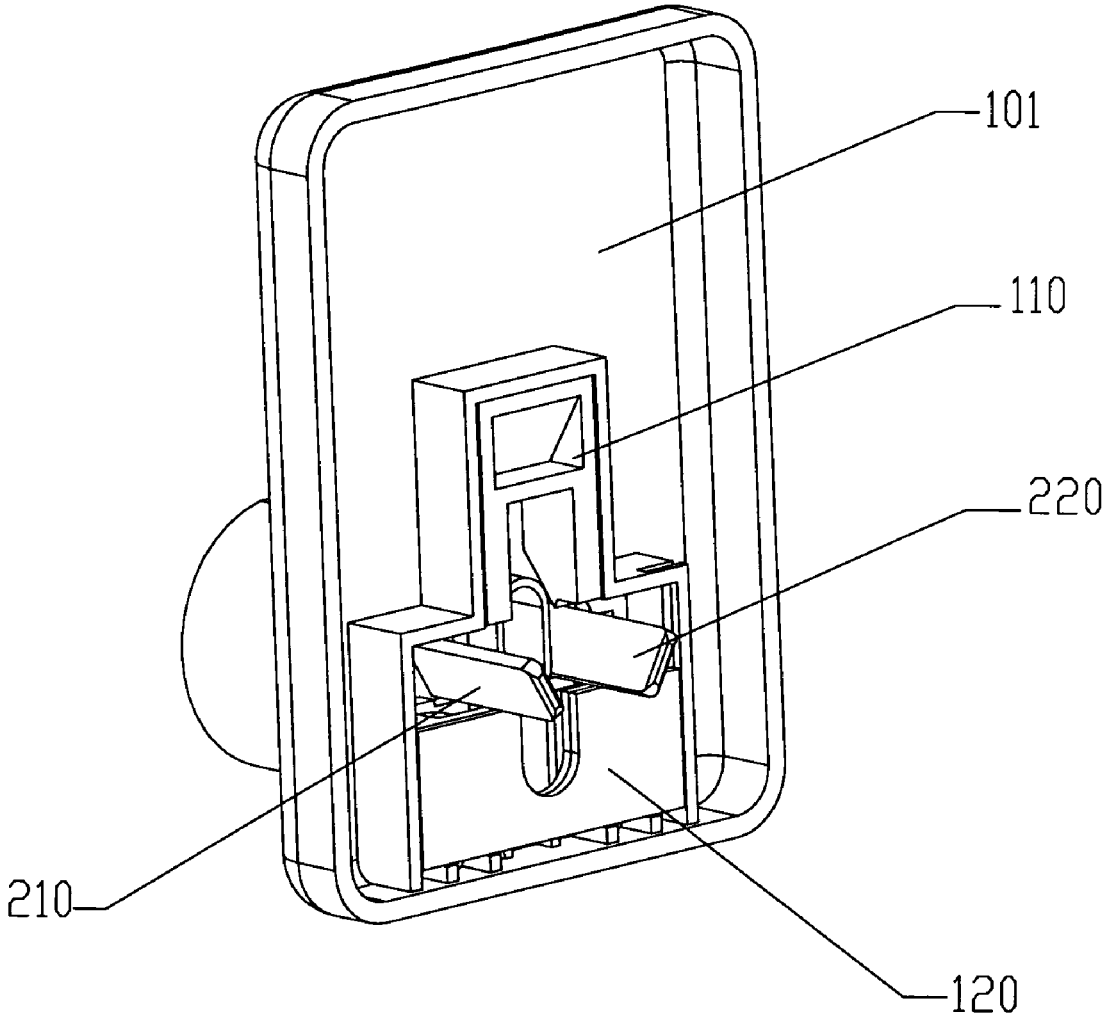
FIG. 4*a*-FIG. 4*f* are illustrations of the safety protection structure for universal sockets adapted to extratensive blade-terminal 2-pin plugs.
Figure 4B:
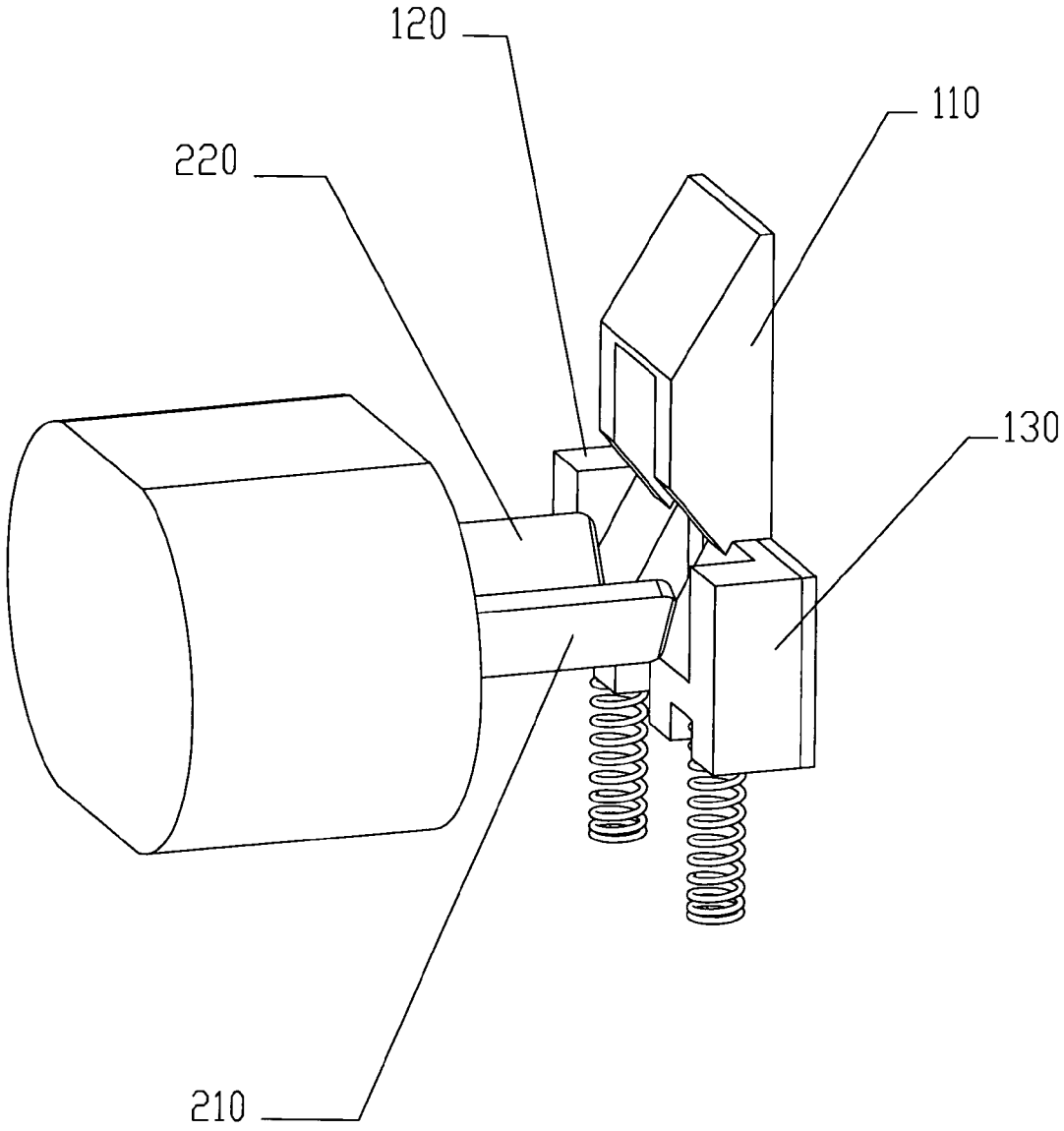
Figure 4C:
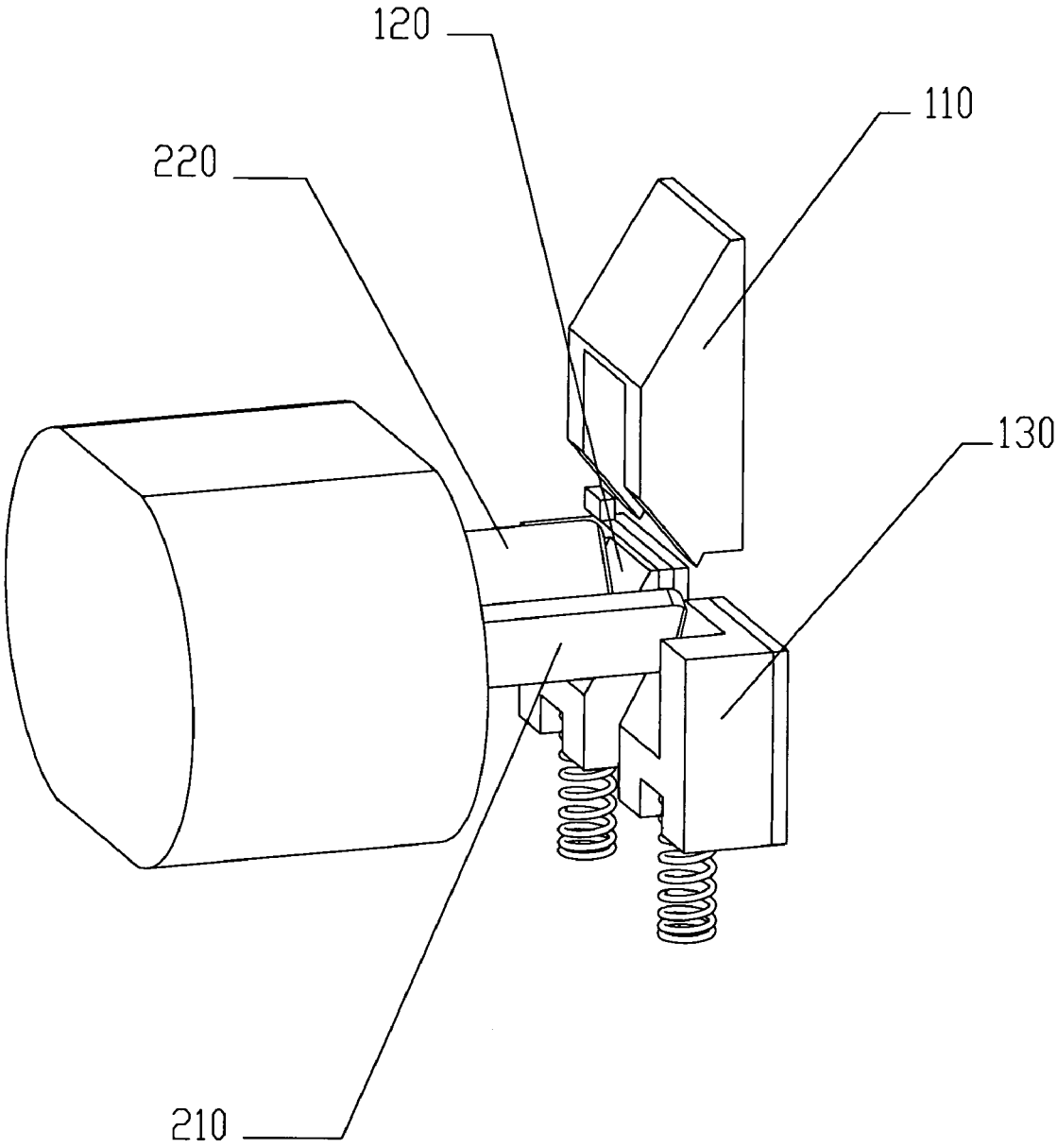
Figure 4D:
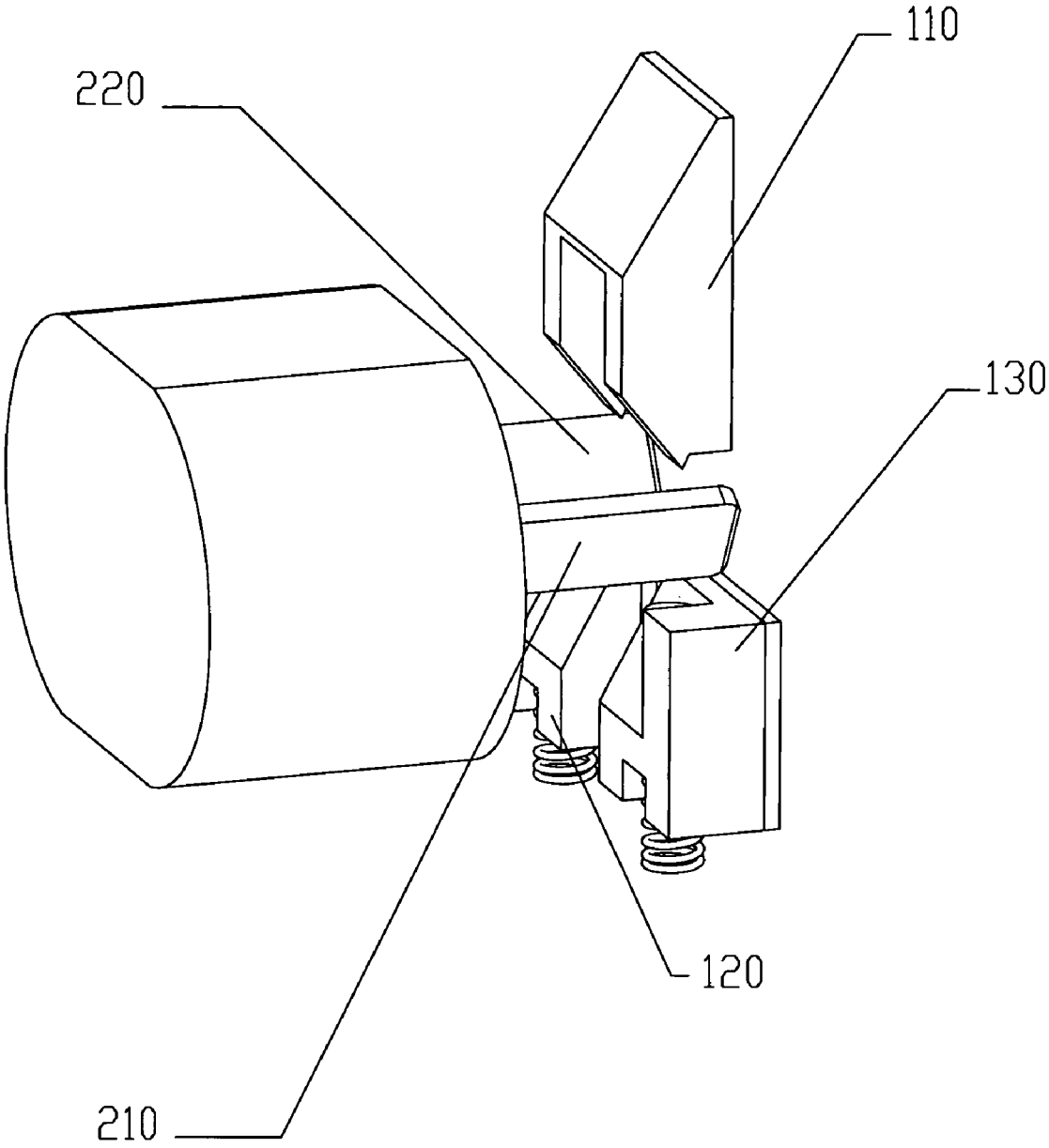
Figure 4E:
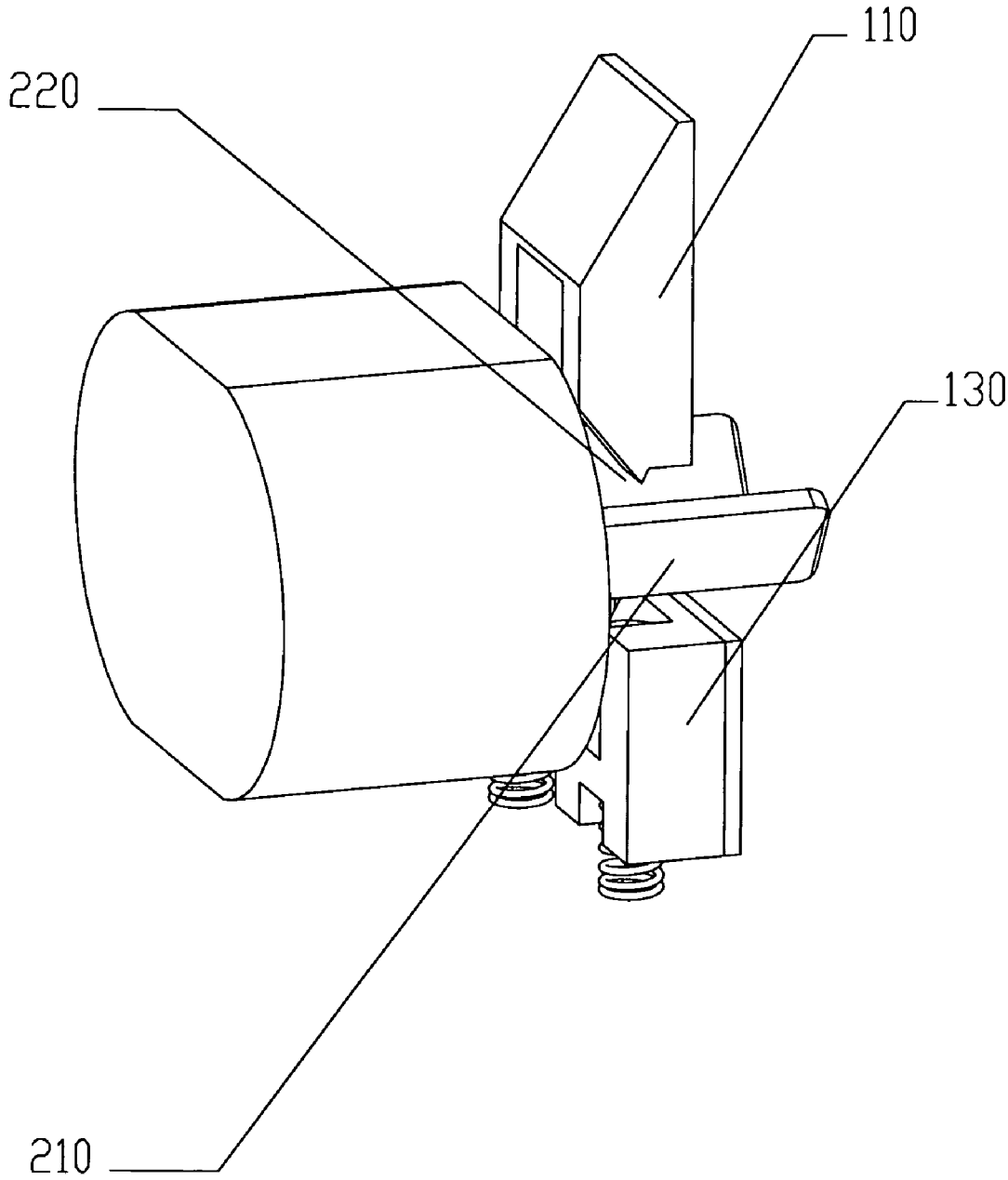
Figure 4F:
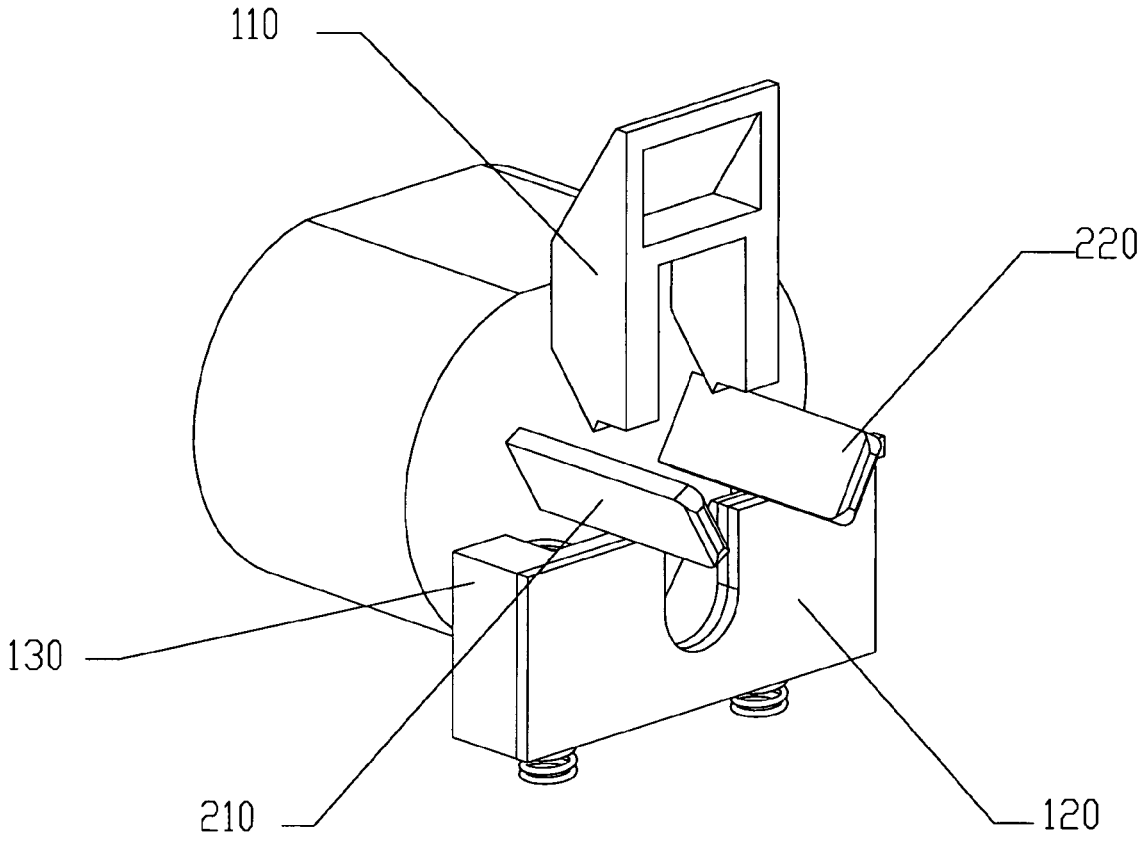

FIG. 4*a*-FIG. 4*f* illustrate situations when the universal socket is inserted with a 2-pin plug. When the first pin 210 and the second pin 220 of the 2-pin plug are inserted into the jacks corresponding to the second module 120 and third module 130, as shown in FIG. 4*b*, the top end of the pins will touch the second slant 121 and the third slant 131 respectively, and push the second module 120 and third module 130 to move backward along the slant, as shown in FIG. 4*c*, FIG. 4*d* and FIG. 4*e*, until they touch the conducting plates behind the second module and third module, as shown in FIG. 4*f* (the conducting plates are not shown in the figure).

Figure 5A:
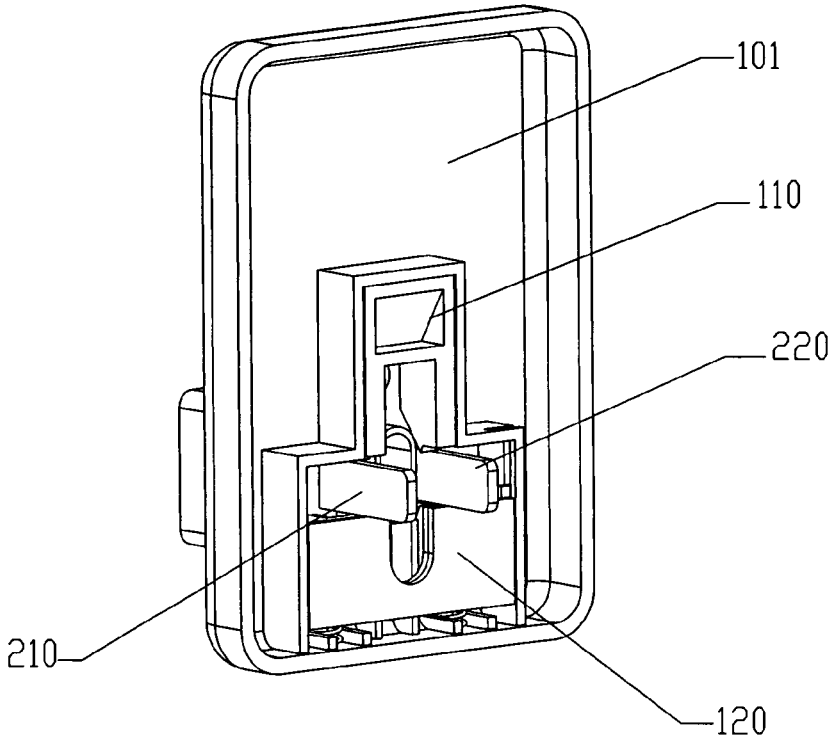
FIG. 5*a* and FIG. 5*b* are illustrations of the safety protection structure for universal sockets adapted to parallel blade-terminal 2-pin plugs.
Figure 5B:
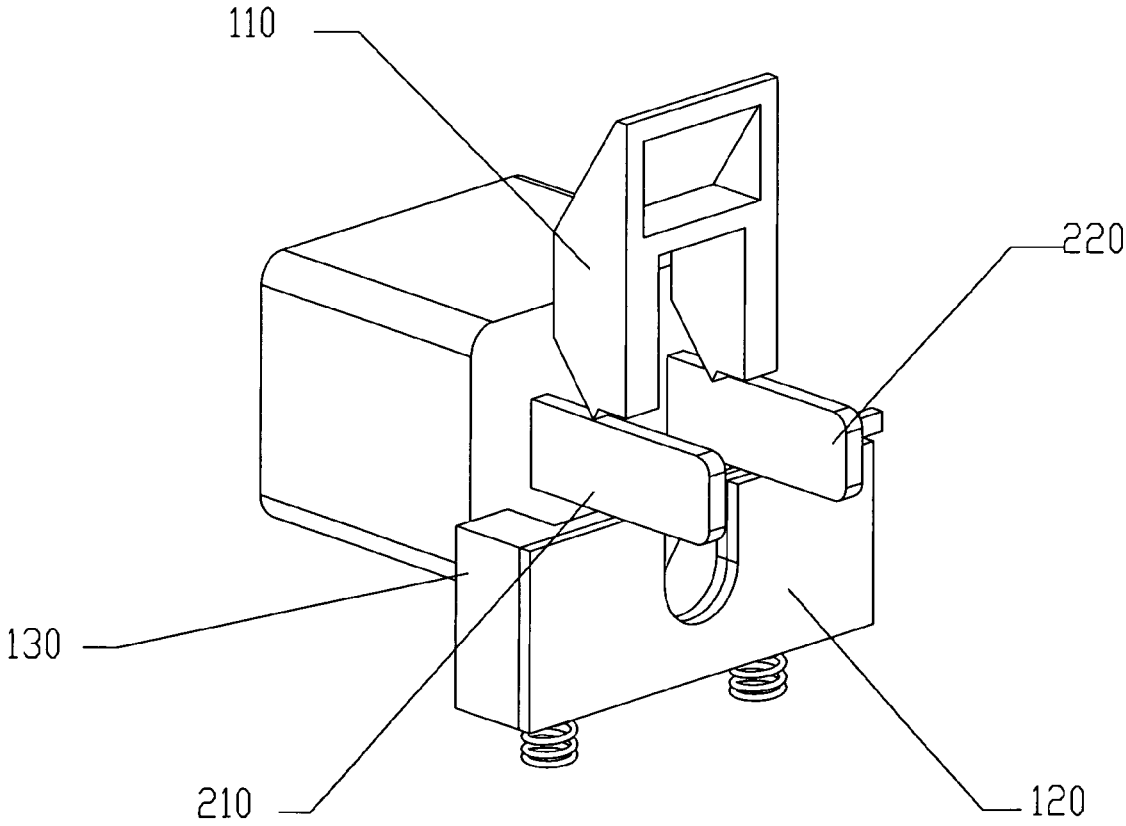

FIG. 5*a* and FIG. 5*b* illustrate a situation when the safety protection structure for universal sockets is inserted with a parallel blade-terminal 2-pin plug. The inserting process is similar to that of the above-described extratensive blade-terminal 2-pin plug.

When the above-mentioned 2-pin plug is inserted correctly, the first module 110 will remain intact, ensuring that the conducting plate corresponding to the first module will not be exposed and will not cause any danger in the jack. Through the structural design of first module, second module and third module, the universal socket perfectly ensures safety of the socket upon incorrect plug inserting.

Although the invention has been explained in relation to its preferred embodiment, it is to be understood that many other possible modifications and variations can be made without departing from the spirit and scope of the invention as hereinafter claimed.

What is claimed is:

1. A safety protection structure for universal sockets, configured between an upper case and a lower case of a universal socket in correspondence to a jack on the upper case to prevent abnormal connection between a plug and a conducting plate in the universal socket, said safety protection structure comprising:

a first module, with a first slant contacting a first pin of a 3-pin plug;

a second module having a movement direction, with a second slant contacting a second pin of the 3-pin plug, and a sliding chute configured in parallel to the movement direction of said second module;

a third module, with a third slant contacting a third pin of the 3-pin plug, and matching the sliding chute of the second module; said sliding chute configured to ensure that the third module and the second module are relatively independent and movable;

said second module and third module are respectively configured with a surface area to block the second pin and third pin of said 3-pin plug at the same time; and said first module configured with a bottom surface to push said second module and third module and make them move simultaneously.

2. The safety protection structure for universal sockets as claimed in claim 1, wherein an overlapped U-notch is configured in the center of said second module and third module for positioning during assembly.

3. The safety protection structure for universal sockets as claimed in claim 2, wherein the upper case and the lower case are configured with clasps to form walls and an enclosure space to house the safety protection structure.

4. The safety protection structure for universal sockets as claimed in claim 3, wherein the walls have a bottom configured with two notches for mounting two springs to support bottom surfaces of said second module and third module respectively.

5. The safety protection structure for universal sockets as claimed in claim 4, wherein a side of said third module is configured with a positioning projection to match a retaining groove on said second module, said retaining groove being an opening of the sliding chute on a side wall of said second module.

6. The safety protection structure for universal sockets as claimed in claim 5, wherein the width of said first slant matches the width of the first pin of a specific 3-pin plug when inserted correctly and the width of said second slant and third slant is configured to be smaller than the width of the corresponding pin of a specific 3-pin plug.

7. The safety protection structure for universal sockets as claimed in claim 6, wherein the 3-pin plug is a British Standard 13a plug.

8. The safety protection structure for universal sockets as claimed in claim 6, wherein the jacks on the upper case are configured to be adaptable to universal jacks of multiple specifications.

9. A safety protection structure for universal sockets, configured between an upper case and a lower case of a universal socket in correspondence to a jack on the upper case to prevent abnormal connection between a plug and a conducting plate in the universal socket, said safety protection structure comprising:

a second module having a movement direction with a second slant contacting a first pin of a 2-pin plug, and a sliding chute comprising a pair of spaced plates configured in parallel to the movement direction of said second module, and transversely spaced relative to the movement direction;

a third module, with a third slant contacting a second pin of the 2-pin plug, and comprising a plate slideably received in the sliding chute, said sliding chute configured to ensure that the third module and the second module are relatively independent and movable;

said second module and said third module are respectively configured with a surface area to block the first pin and second pin of said 2-pin plug at the same time.

10. The safety protection structure for universal sockets as claimed in claim 9, wherein an overlapped U-notch is configured in the center of said second module and third module for positioning during assembly.

11. The safety protection structure for universal sockets as claimed in claim 10 and further comprising a wall having a protruding positioning part configured to fit said overlapped U-notch.

* * * * *